US005730707A

United States Patent [19]

Vang

[11] Patent Number: 5,730,707

[45] Date of Patent: Mar. 24, 1998

[54] POWER SUPPLY FOR VIBRATING FURNITURE

[75] Inventor: David Vang, Sheboygan, Wis.

[73] Assignee: Raffel Product Development Co., Saukville, Wis.

[21] Appl. No.: 630,722

[22] Filed: Apr. 8, 1996

[51] Int. Cl.[6] ..... A61H 1/00

[52] U.S. Cl. ..... 601/49; 601/58; 601/70; 363/63

[58] Field of Search ..... 601/46, 48, 49, 601/56–60, 65–70, 78, 107, 108, 111; 363/63, 100

[56] References Cited

U.S. PATENT DOCUMENTS

| | | |
|---|---|---|
| Re. 31,603 | 6/1984 | Christensen . |
| 4,856,130 | 8/1989 | Berkovich . |
| 4,920,583 | 5/1990 | Hough et al. . |
| 5,022,384 | 6/1991 | Freels et al. . |
| 5,188,096 | 2/1993 | Yoo . |
| 5,437,608 | 8/1995 | Cutler . |

*Primary Examiner*—Danton D. DeMille
*Attorney, Agent, or Firm*—Michael, Best & Friedrich

[57] ABSTRACT

A vibration producing system for use in vibratory furniture and including first and second vibrator motors for producing vibrations upon being energized, a full wave rectifier having input terminals connected to the power supply and a pair of output terminals for providing full wave rectified current. A first switch has a first mode for connecting the first vibrator motor to the output terminals, a second mode for connecting the vibrator motor to the rectifying means so that the first vibrating means receives alternate half waves of the alternating current having a first polarity and a third mode for open circuiting the first vibrator motor. A second switch has a first mode for connecting the second vibrator motor to the output terminals, a second mode for connecting the second vibrator motor to the rectifying means so that the second vibrator motor receives alternate half waves of the alternating current having a second polarity, and a third mode for open circuiting the second vibrator motor.

4 Claims, 1 Drawing Sheet

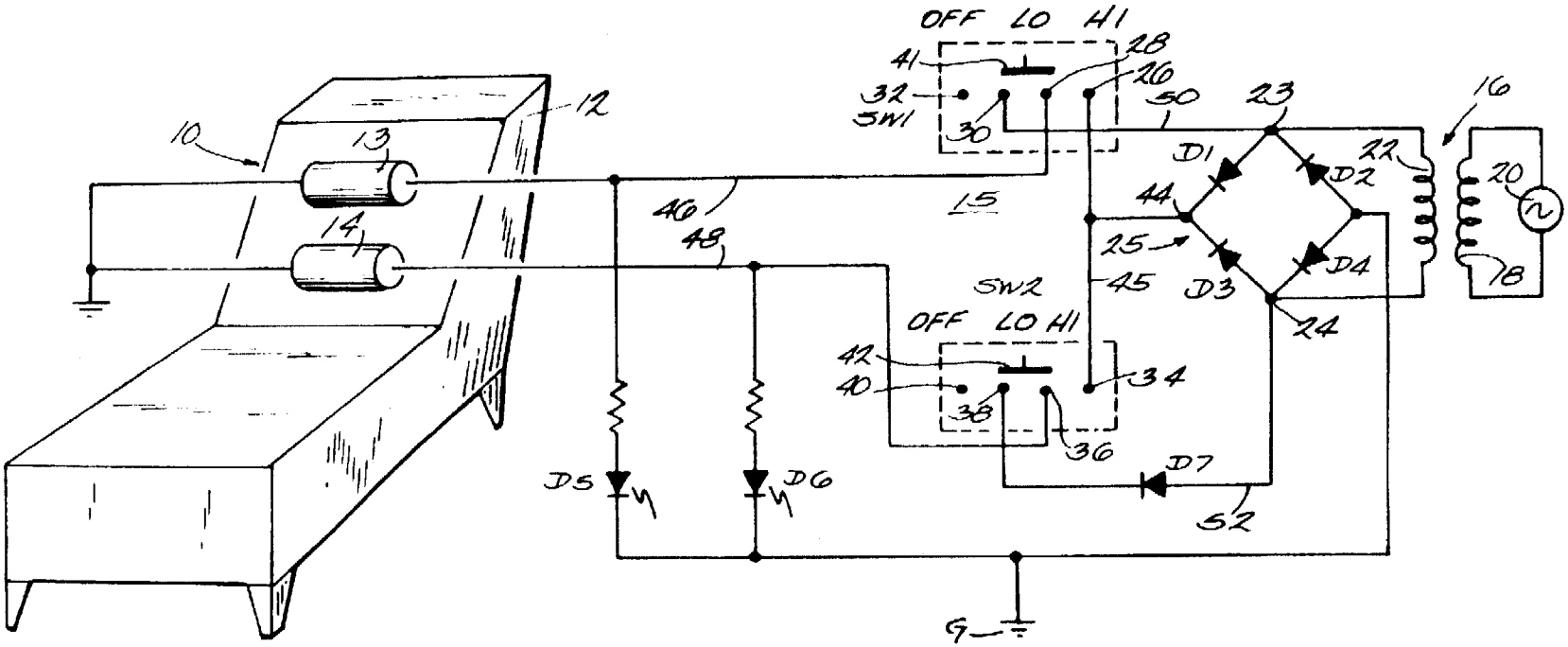
16
20
18
22
D2
D4
23
24
D1
D3
52
D7
44
25
45
34
28
26
50
HI
LO
OFF
36
SW2
LO HI
OFF
30
38
15
41
32
SW1
42
40
G
D6
46
48
D5
12
13
14
10

POWER SUPPLY FOR VIBRATING FURNITURE

BACKGROUND OF THE INVENTION

This invention relates to a massaging apparatus, and more particularly, to a control for massaging apparatus incorporated into an article of furniture.

Body massage systems generally comprise an article of furniture, such as a mattress, lounge or chair having a plurality of vibrators which may be energized in a variety of predetermined sequences so as to provide the desired massaging effect. The vibratory action is commonly provided by a plurality of vibrating motors which may be portable or fixed to the article of furniture. In fixed systems, the vibrating motors are usually mounted on the frame, the springs, or embedded in the padding. In portable devices, the vibrating motors are mounted on resilient tubes or bars which are inserted between a mattress and box spring, for example.

Energy for the vibrating motors of such prior art systems was generally provided by transformers and rectifiers which coupled the motors for receiving alternate half cycles of the power supply system. The energy level was adjusted by controlling the duration of each motor energizing pulse. Because of the heat dissipation requirements in such systems, relatively large transformers are required.

SUMMARY OF THE INVENTION

It is an object of the invention to provide a new and improved energy supply for the vibrator system of a body massage apparatus.

Another object of the invention is to provide an energy supply for the vibrator motors of a body massage apparatus which permits the use of a relatively smaller transformer.

A further object of the invention is to provide a more efficient power supply for the vibrator motors used in massaging apparatus.

These and other objects and advantages of the present invention will become more apparent from the detailed description thereof taken with the accompanying drawings.

In general terms, the invention comprises a vibration producing system for use in an article of furniture and including at least first and second vibrating means coupled to the article of furniture for producing vibrations upon being energized, a power supply for the vibrating means including a source of alternating current and full wave rectifying means having input terminals connected to the power supply and a pair of output terminals for providing rectified current from the output terminals. The invention also includes a first switch means coupled to the first vibrating means and the rectifying means and having a first mode for connecting the first vibrating means to the output terminals so that the first vibrating means receives full wave rectified current therefrom, a second mode for connecting the first vibrating means to the rectifying means so that the first vibrating means receives successive half waves of the alternating current having a first polarity and a third mode for open circuiting the first vibrating means. In addition, the invention also includes second switch means coupled to the second vibrating means and the rectifying means having a first mode for connecting the second vibrating means to the output terminals so that the second vibrating means receives full wave current therefrom, a second mode for connecting the second vibrating means to the rectifying means so that the second vibrating means receives successive half waves of the alternating current having a second polarity, and a third mode for open circuiting the second vibrating means.

The invention also comprises a method of controlling the level of energy supplied to a pair of vibrators coupled to an article of furniture for imparting vibrations in spaced apart locations to a user mounted thereon, comprising the steps of selectively supplying one of the vibrators with either full wave rectified current from an alternating current source for generating maximum vibration intensity, a half wave of the alternating current having a first polarity for generating low vibration intensity or open circuiting the one vibrator, selectively supplying the other vibrator with either full wave rectified current from the alternating current source to provide a high level of vibration intensity, a half wave of the alternating current source and having a different polarity for providing a low level of vibrating intensity, or open circuiting the second vibrator whereby the full wave rectified current is utilized when both of said vibrators are either set for high vibration intensity or low vibration intensity.

BRIEF DESCRIPTION OF THE DRAWINGS

The single FIGURE of the drawings schematically illustrates a massaging apparatus incorporating the present invention.

DETAILED DESCRIPTION OF THE PREFERRED EMBODIMENT

The drawing schematically illustrates an article of furniture 10 which may be a chair, a lounge, a mattress or the like. The article of furniture is symbolized by a pad 12, formed of any suitable material and at least a pair of vibratory motors 13 and 14. It will be appreciated that the pad 12 may be supported by a pad and springs (not shown). The vibratory motors 13 and 14 may be coupled to the article of furniture 10 in any suitable manner. For example, motors 13 and 14 may be mounted on the frame, the springs in the padding 12, or they may be mounted on tubular members which are inserted between portions of the article of furniture, such as between a chair and a cushion, or a mattress and a box spring. In the illustrated embodiment, the vibratory motors are shown to be mounted in the pad 12 for purposes of illustration. The position of the vibratory motors 13 and 14 relative to the article of furniture 10 depends upon the areas of the body that are to be vibrated. In the illustrated example, the vibratory action would be in the upper and lower back. The vibrators 13 and 14 may comprise any well known type of electrical device which produces vibrations upon being energized. In the preferred embodiment, the vibrators 13 and 14 comprise electric motors having an eccentrically weighted output shaft.

The power supply circuit 15 for the vibrator motors 13 and 14, includes a transformer 16 having a primary winding 18 connected to a power source 20, such as, a 60 cycle, 120 volt system. The secondary winding 22 of transformer 16 is connected to the input terminals 23 and 24 of a full wave rectifier 25 consisting of diodes D1, D2, D3 and D4. The rectifier 25 is connected to motor 13 through switch SW1 which has a first mode for connecting the motor 13 for receiving full wave rectified current from the rectifier 25, a second mode for connecting the motoring 13 for receiving successive half waves of the rectified current having a first polarity from the transformer secondary winding 22 and a third mode for open circuiting the motor 13. Similarly, the rectifier 25 is connected to the motor 14 through the switch SW2 which has a first mode for connecting the motor 13 for receiving full wave rectified current from the rectifier 25, a second mode for receiving half wave rectified current having a second polarity from the transformer secondary winding 22 and a third mode for open circuiting the motor 14. While any mechanical or electronic switch capable of performing these functions may be employed, switch SW1 is symbolized by a mechanical switch having contacts 26, 28, 30 and 32 and slide member 33 and switch SW2 is symbolized by a mechanical switch having contacts 34, 36, 38 and 40 and slide member 41. The slide members 33 and 41 are movable to selectively connect pairs of adjacent contacts.

Switch contacts 26 and 34 are each connected by conductor 45 to the rectifier output terminal 44, contacts 28 and 36 are connected by conductors 46 and 48 to vibratory motors 13 and 14, respectively. Contacts 30 and 38 are connected by conductors 50 and 52 to the input terminals 23 and 24, respectively, of rectifier 25. Contact pair 26 and 28 of switch SW1 are labeled HI, contact pair 28 and 30 are labeled LO, and contact pair 30 and 32 are labeled OFF. The corresponding contacts of switch SW2 are similarly labeled.

When the contact 41 is positioned to connect terminals 30 and 32 and the contact member 42 is positioned to connect terminals 38 and 40, each of the motors 13 and 14 is open circuited. Movement of the contact member 41 to contacts 26 and 28, or the HI position, connects motor 13 to output terminal 44 of rectifier 25 through conductors 45 and 46. As a result, the motor 13 receives the full wave rectified or maximum current. Similarly, movement of contact member 42 to contacts 34 and 36 connects motor 14 to terminal 44 through conductors 45 and 48 so that motor 14 also receives the full wave rectified current.

Movement of contact member 41 to contacts 28 and 30 and contact member 42 add contacts 36 or 38, or the LO positions, connects motor 13 to rectifier terminal 23 through conductors 46 and 50 and motor 14 to rectifier terminal 24 through conductors 48 and 52. During each positive half cycle of the alternating output current from transformer secondary winding 22, that is, when terminal 23 is positive, and terminal 24 is negative, motor 13 is energized while motor 14 is grounded through diodes D4 and D7. During each negative half cycle, that is when terminal 24 is negative and terminal 23 is positive, motor 14 is energized and motor 13 grounded through diode D2. It can be seen, therefore, that when the switches SW1 and SW2 are each in their HI positions, motors 13 and 14 are energized by full wave rectified current. On the other hand, when each of the switches SW1 and SW2 are in the LO positions, the motors 13 and 14 are energized by alternate half cycles of the rectified current. As a result, the current flowing through the motors 13 and 14 is balanced and, in each case, the full wave is utilized. As a result, heating of the transformer 16 is minimized and a relatively smaller transformer can be employed.

LEDs D5 and D6 may be connected to conductors 46 and 48, respectively, for indicating when the motors 13 and/or 14 are energized.

While only a single embodiment of the invention is illustrated and described, it is not intended to be limited thereby, but only by the scope of the appended claims.

I claim:

1. A vibration producing system for use in vibratory furniture and including at least first and second vibrating means for producing vibrations upon being energized, rectifying means connected to an alternating current power supply for rectifying the alternating current from the power supply, first switch means having a first mode for connecting said first vibrating means to said rectifying means so that said first vibrating means receives full wave rectified current therefrom, a second mode for connecting said first vibrating means to said rectifying means so that said first vibrating means receives alternate half waves of the alternating current having a first polarity and a third mode for open circuiting said first vibrating means, second switch means having a first mode for connecting said second vibrating means to said rectifying means so that said first vibrating means receives full wave rectified current therefrom, a second mode for connecting said second vibrating means to said rectifying means so that said first vibrating means receives alternate half waves of the alternating current having a second polarity, and a third mode for open circuiting said second vibrating means.

2. The vibration producing system of claim 1 wherein said rectifying means comprises a full wave rectifier having input terminals adapted to be connected to an alternating current supply and a pair of output terminals, said first switch means being operative in its first mode for connecting said first vibrating means to said output terminals, said second switch means being operative in its first mode for connecting said second vibrating means to said output terminals.

3. The vibration producing system set forth in claim 2 wherein said first and second vibrating means comprises vibrating motors.

4. A method of controlling the level of energy supplied to a pair of vibrators coupled to an article of furniture for imparting vibrations in spaced apart locations to a user mounted thereon, comprising the steps of, selectively supplying one of the vibrators with either full wave rectified current from an alternating current source for generating a first level intensity, a half wave of the alternating current having a first polarity for generating lower vibration intensity than said first level or open circuiting the one vibrator, selectively supplying the other vibrator with either full wave rectified current from the alternating current source to provide a level of vibration intensity substantially equal to said first level, a half wave of the alternating current source and having a different polarity for providing a lower level of vibrating intensity than said first level, or open circuiting the second vibrator, whereby the full wave rectified current is utilized when both of said vibrators are either set for high vibration intensity or low vibration intensity.

* * * * *